US008128137B2

(12) United States Patent
Takaya et al.

(10) Patent No.: US 8,128,137 B2
(45) Date of Patent: Mar. 6, 2012

(54) VEHICLE DOOR HANDLE APPARATUS

(75) Inventors: Hirotaka Takaya, Hiroshima (JP); Tsuyoshi Muneta, Hiroshima (JP)

(73) Assignee: U-Shin Ltd., Tokyo (JP)

( * ) Notice: Subject to any disclaimer, the term of this patent is extended or adjusted under 35 U.S.C. 154(b) by 942 days.

(21) Appl. No.: 12/149,826

(22) Filed: May 8, 2008

(65) Prior Publication Data

US 2008/0277948 A1 Nov. 13, 2008

(30) Foreign Application Priority Data

May 10, 2007 (JP) ..... 2007-125751

(51) Int. Cl.
*E05B 3/00* (2006.01)

(52) U.S. Cl. ..... 292/336.3; 292/347; 292/348

(58) Field of Classification Search ..... 292/336.3, 292/347, 348; 16/110.1
See application file for complete search history.

(56) References Cited

U.S. PATENT DOCUMENTS 6,672,633 B2 * 1/2004 Nomura et al. ..... 292/336.3
6,749,236 B2 * 6/2004 Nomura et al. ..... 292/336.3
6,880,870 B2 * 4/2005 Costigan ..... 292/336.3

FOREIGN PATENT DOCUMENTS

JP 2001-323689 11/2001

* cited by examiner

*Primary Examiner* — Kristina Fulton
(74) *Attorney, Agent, or Firm* — Wenderoth, Lind & Ponack, L.L.P.

(57) ABSTRACT

To provide a supporting structure of a rotating section which offers not only facilitated mounting but also resistance to dropout. There are provided a handle base 1 for rotatably supporting one end side of a handle grip 2, and a lever 3 which has a shaft section 23 rotatably supported by a bearing section 11 of the handle base 1 and which is rotated upon pulling of the handle grip 2. The lever 3 includes a first shaft tip section 27 projecting from the shaft section 23 to a shaft tip side and having a part cut away so as to form a circular face, and a second shaft tip section 28 projecting from the first shaft tip section 27 to a shaft tip side and having a width smaller than that of the first shaft tip section 27. The handle base 1 includes a bearing hole 16 for rotatably supporting the first shaft tip section 27 and the second shaft tip section 28 of the lever 3, a first guide rail 17 for guiding the first shaft tip section 27 to the bearing hole 16, and a second guide rail 18 narrower than the first shaft tip section 27 for guiding the second shaft tip section 28 to the bearing hole 16.

10 Claims, 9 Drawing Sheets

VEHICLE DOOR HANDLE APPARATUS

BACKGROUND OF THE INVENTION

The present invention relates to a vehicle door handle apparatus.

A publicly-know conventional vehicle door handle apparatus includes those having a link which is rotatably supported on a frame and which is rotated by operation of a handle grip (see, e.g., JP 2001-323689 A).

However, the conventional vehicle door handle apparatus is structured so that a width across flat section formed in a shaft section of the link is inserted in a narrow slot formed in the frame and that the shaft section is rotatably supported by a bearing hole. This facilitates mounting work, but at the same time, as the link rotates and a part of the width across flat section is thereby located in the slot, this part may lose support and eccentric force may act on the shaft section, resulting in dropout of the shaft section from the bearing hole.

SUMMARY OF THE INVENTION

Accordingly, an object of the present invention is to provide a vehicle door handle apparatus in which a supporting structure of a rotating section offers not only facilitated mounting but also resistance to dropout.

A vehicle door handle apparatus includes: a handle base for rotatably supporting one end side of a handle grip; and a lever which has a shaft section rotatably supported by a bearing section of the handle base and which is rotated upon pulling of the handle grip, wherein the lever includes: a first shaft tip section projecting from the shaft section to a shaft tip side and having a part cut away so as to form a circular face; and a second shaft tip section projecting from the first shaft tip section to a shaft tip side and having a width smaller than that of the first shaft tip section, and wherein the handle base includes: a bearing hole for rotatably supporting the first shaft tip section and the second shaft tip section of the lever; a first guide rail for guiding the first shaft tip section to the bearing hole; and a second guide rail narrower than the first shaft tip section for guiding the second shaft tip section to the bearing hole.

With this configuration, even when the shaft section is rotatably supported by the bearing hole and in this state, a part of the first shaft tip section moves to a position corresponding to the first guide rail where the held state of the part of the first shaft tip section is canceled, the pivotally supported state of the second shaft tip section by the bearing hole is maintained until a part of the second shaft tip section moves to a position corresponding to the second guide rail, so that the range in which the shaft section may drop out can be held down compared with the conventional cases. In short, it becomes possible to implement a structure offering resistance to dropout without spoiling mounting workability through simple improvement. Moreover, even when the second shaft tip section is formed with a small width, the shaft section is held in the bearing hole by the first shaft tip section which is wider than the second shaft tip section, and therefore the strength of the shaft section is not compromised.

It is more preferable, in view of achieving effective prevention of the dropout of the shaft section from the bearing section, to further provide a return spring which biases the lever in a rotation direction around the shaft section and which has engaging sections on both ends engaged so that eccentric force may act in a direction in which the first shaft tip section is distanced from the first guide rail.

Preferably, the first guide rail is formed so as to be displaced from a straight line passing through a center of the bearing hole, the second guide rail is formed outside of the first guide rail further away from the straight line passing through the center of the bearing hole, and a rotation direction of the shaft section of the lever at a time of pulling the handle grip is so set that an end section of an end face of the first shaft tip section and the second shaft tip section may reach a lateral face of the first guide rail prior to a lateral face of the second guide rail.

With this configuration, even when, for example, the lever is operated by an operator in the rotation direction for pulling operation of the handle grip during assembling work and the like, the first shaft tip section and the second shaft tip section may be structured to be less likely to drop out of the bearing hole.

It is preferable to provide a return spring which biases the lever in a rotation direction around the shaft section and which has engaging sections on both ends engaged so that eccentric force may act in a direction in which the first shaft tip section is distanced from the first guide rail, wherein the bearing hole is placed so that a center thereof is displaced from a center of each shaft section, which is guided via each of the guide rails, in a direction crossing the guiding direction, and wherein after the first shaft tip section is inserted into the bearing hole via the first guide rail, the bearing hole is in a state of being displaced in the crossing direction, and the displaced state is held by the eccentric force of the return spring.

With this configuration, it becomes possible to prevent at least the first shaft tip section from being placed at the position where the first shaft tip section can drop out of the first guide rail by just inserting the first shaft tip section into the first guide rail and moving it in the crossing direction. In short, it becomes possible to implement the structure which offers resistance to dropout only by mounting the shaft section so as to be rotatably supported by the bearing hole. The state of being unable to drop out is maintained by the eccentric force of the return spring. Therefore, even as the lever rotates to a rotating position for mounting operation, the shaft section of the lever does not drop out from the bearing hole, and therefore the rotating position for mounting the lever can be set in the normal operation range of the lever. As a result, it becomes possible to enhance the design flexibility.

When a position at which one edge of the circular face of the first shaft tip section comes into contact with an inner peripheral face of the bearing hole in a state that the other edge of the circular face is positioned in one outer lateral surface of the first guide rail is used as a rotary fulcrum of the shaft section, one edge of the second shaft tip section is preferably structured at least not to enter into the second guide rail.

With this configuration, even as the lever rotates and one edge in the circular face of the first shaft tip section reaches the first guide rail, the held state of one edge of the first shaft tip section is canceled. In this case, if one edge of the second shaft tip section is structured so as not to enter into the second guide rail, the second shaft tip section is still put in the state of being held in the inner peripheral face of the bearing hole, and therefore the second shaft tip section is prevented from dropping into the second guide rail. In short, it becomes possible to make the shaft section hardly drop out of the bearing section.

According to the invention, even when the shaft section is rotatably supported by the bearing hole and in this state, a part of the first shaft tip section moves to a position corresponding to the first guide rail where the held state of the part of the first shaft tip section is canceled, the pivotally supported state of the second shaft tip section by the bearing hole is maintained until a part of the second shaft tip section moves to a position corresponding to the second guide rail, so that the range in which the shaft section may drop out can be held down compared with the conventional cases. In short, it becomes possible to provide a structure offering resistance to dropout without spoiling mounting workability through simple improvement.

DETAILED DESCRIPTION OF THE INVENTION

The embodiments of the present invention will be described hereinbelow with reference to the accompanying drawings.

(1. Structure)

Figure 1:
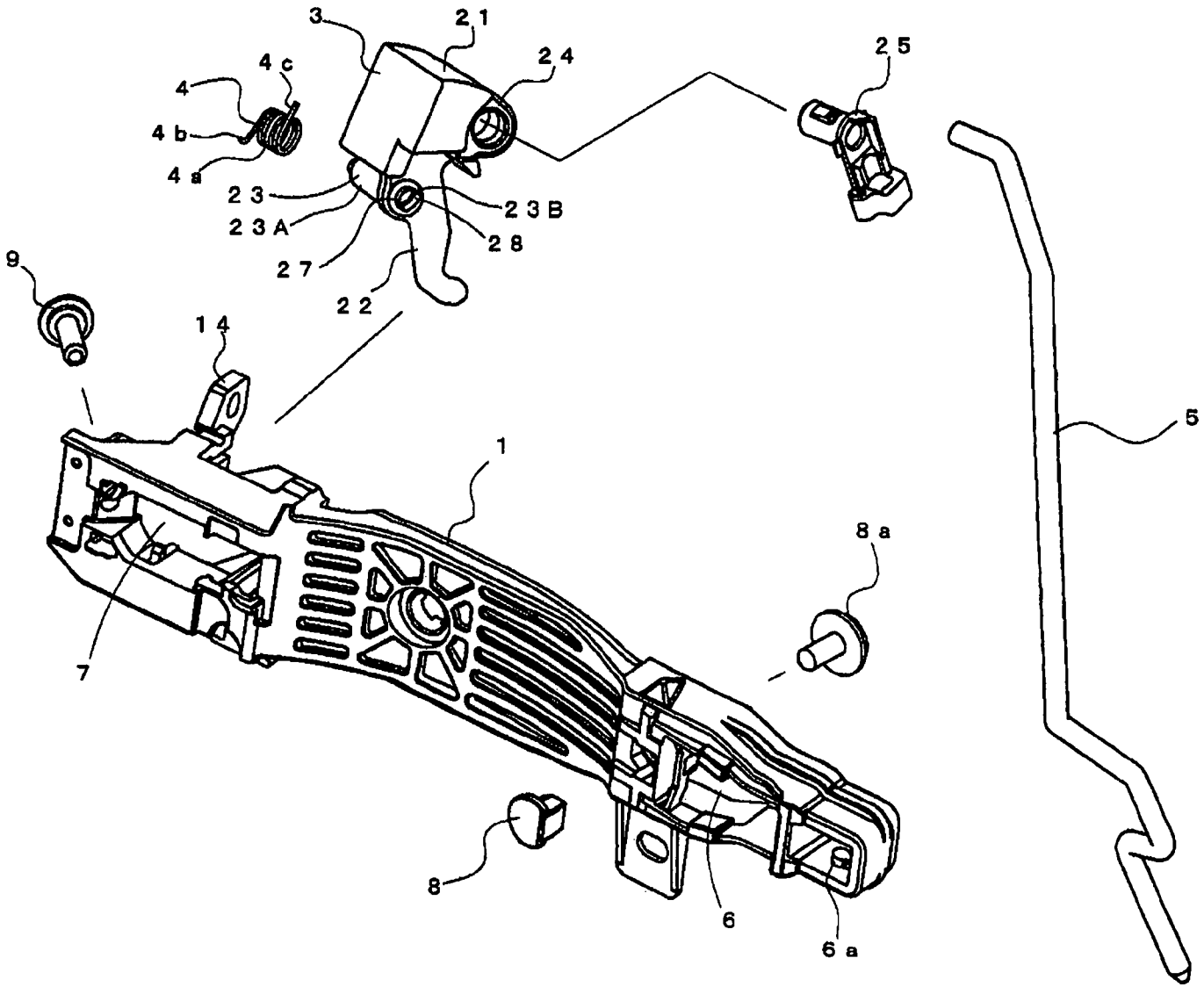
FIG. 1 is an exploded perspective view of a door handle apparatus according to the present embodiment.

FIG. 1 shows a vehicle door handle apparatus according to the present embodiment. The vehicle door handle apparatus is mainly composed of a handle base 1 mounted on an unshown door panel, and a handle grip 2 (see FIG. 8 and FIG. 9), a lever 3 and a return spring 4 mounted on the handle base 1, in which pulling the handle grip 2 rotates the lever 3 against the biasing force of the return spring 4, resulting in operation of an unshown latch mechanism via a rod 5 to open a door.

(1.1. Handle Base 1)

A handle support section 6 on which the handle grip 2 is rotatably mounted is formed in one end section of the handle base 1, while a lever supporting section 7 on which the lever 3 is rotatably mounted is formed in the other end section. The handle support section 6 has a pivotal supporting section 6*a* formed for receiving and rotatably supporting one end section of the handle grip 2, so that the handle grip 2 is rotatably mounted therein. The handle base 1 is fixed onto a door panel with a handle nut 8, a screw 8*a*, a screw 9, and an unshown fixing member.

Figure 2:
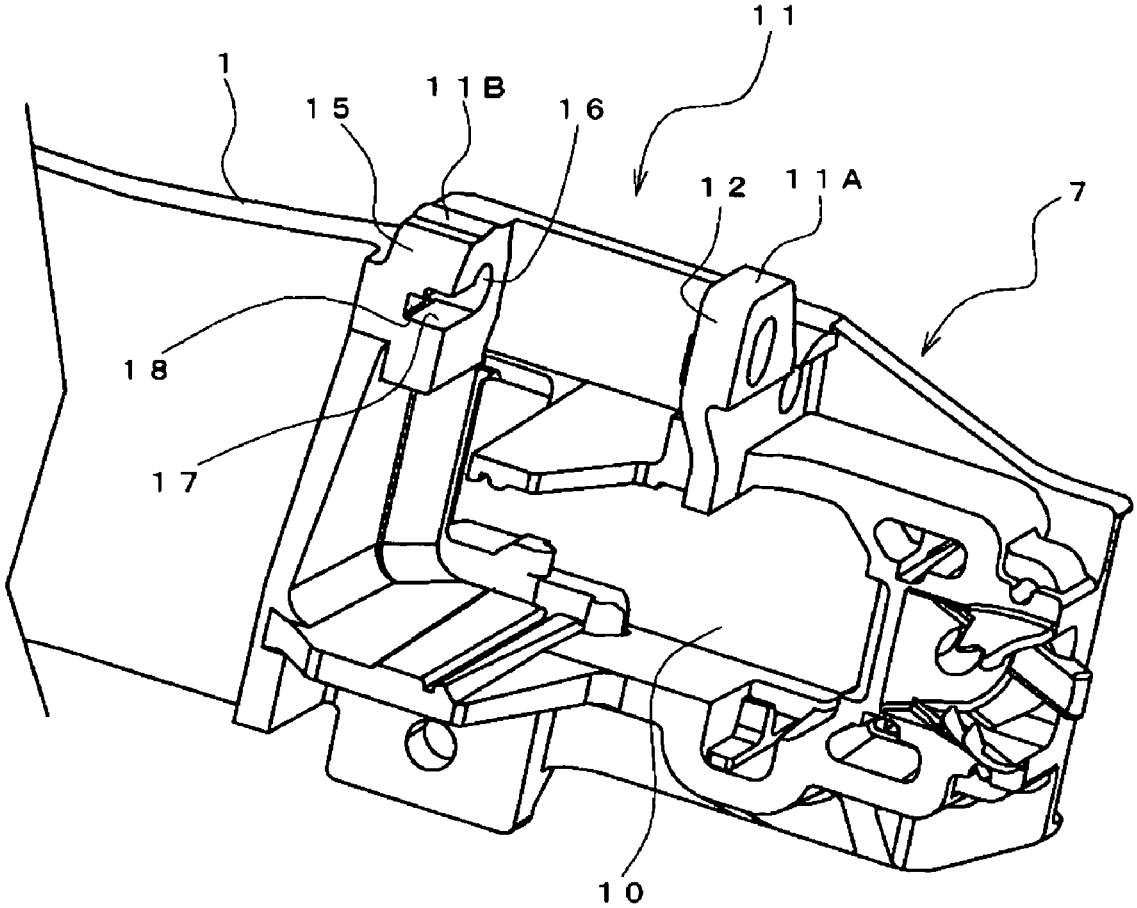
FIG. 2 is a fragmentary enlarged perspective view showing a handle base of FIG. 1 seen from the opposite side.
Figure 3:
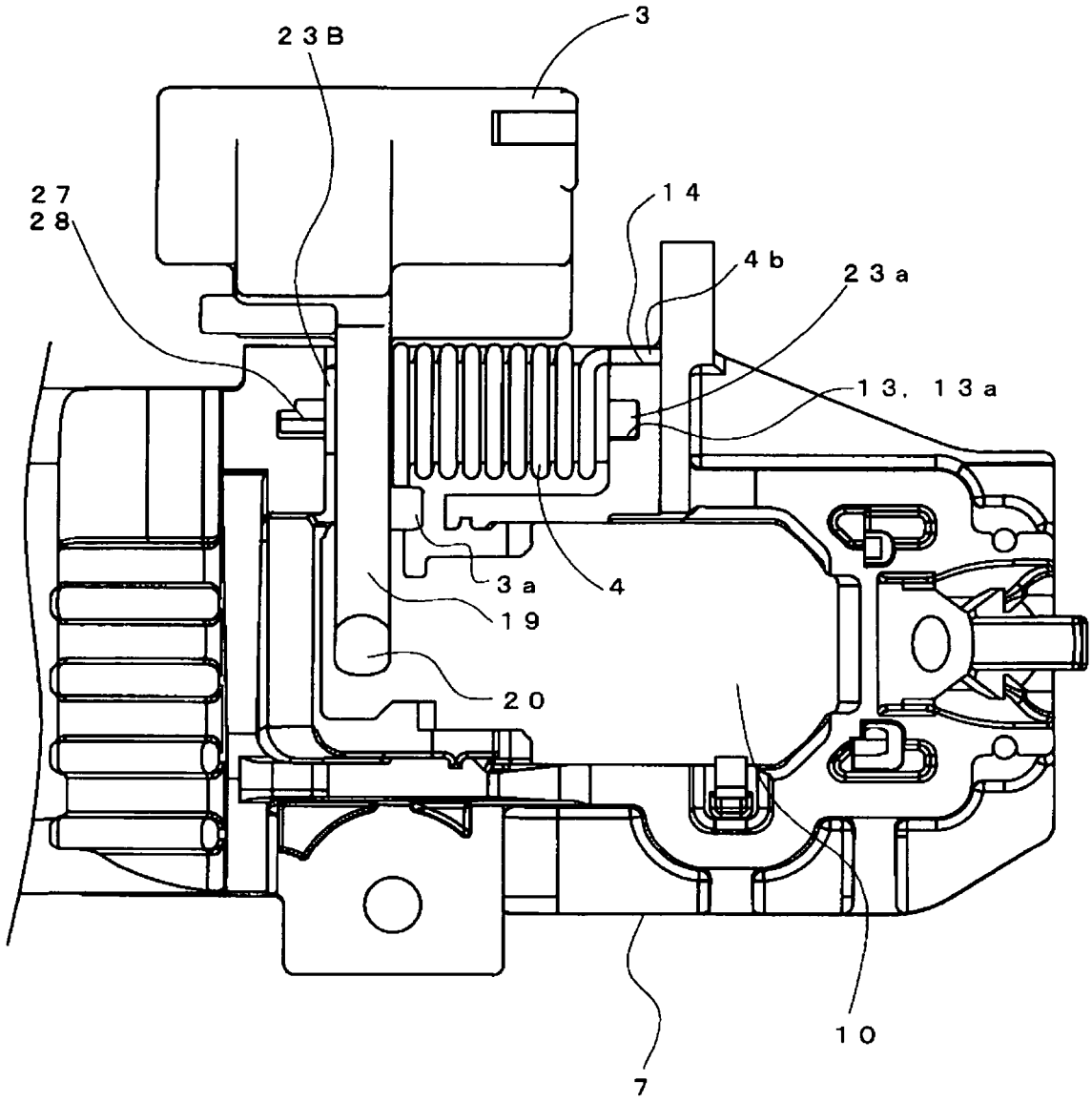
FIG. 3 is a front view showing a lever and a return spring mounted on the handle base of FIG. 2.

The lever supporting section 7 has an opening 10 through which a connecting section 19 and a pressing section 20 of the later-described handle grip 2 are inserted and a bearing section 11 (first bearing section 11A and second bearing section 11B) which supports each shaft section 23 of the lever 3 as shown in FIG. 2 and FIG. 3. The first bearing section 11A has a bearing hole 13 formed in a bearing plate 12 projecting inside and a guide rail 13*a* formed so as to continue to the bearing hole 13. The bearing plate 12 has an engaging groove 14 (see FIG. 3) formed for engaging with one end of the later-described return spring 4.

Figure 4:
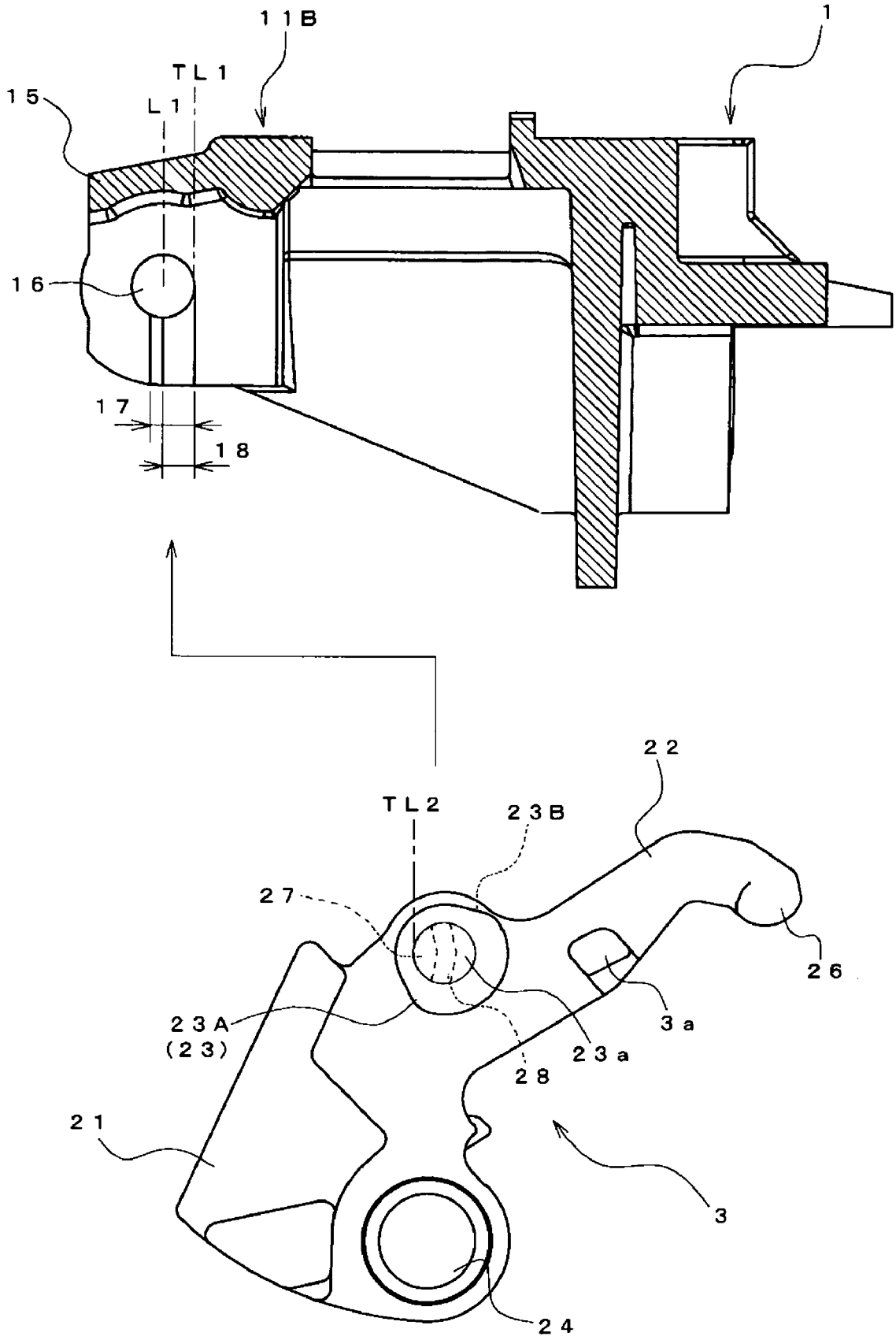
FIG. 4 is a fragmentary cross sectional front view showing the handle base of FIG. 2 before a lever is mounted thereon.

The second bearing section 11B has a bearing hole 16 and a first guide rail 17 and a second guide rail 18 continuing to the bearing hole 16, which are respectively formed in a supporting wall 15. The bearing hole 16 is formed into a recess shape and its inner peripheral face rotatably supports the peripheral face of a second shaft 23B of the later-described lever 3. As shown in FIG. 4, the first guide rail 17 is formed so as to have a width smaller than the outline dimension of the bearing hole 16 at a position displaced from a straight line L1 passing through the center of the bearing hole 16. More specifically, the outer lateral surface (left-hand side in FIG. 4) of the first guide rail 17 is formed on the outer side of the straight line L1 passing through the center of the bearing hole 16 by a prescribed dimension, while the inner lateral surface (right-hand side in FIG. 4) of the first guide rail 17 is formed on a first tangent TL1 on the inner peripheral face of the bearing hole 16. The second guide rail 18 is formed on the rear side of the first guide rail 17 in the page of FIG. 4, i.e., the second guide rail 18 is formed so as to continue to the tip side of the second shaft 23B of the later-described lever 3, with the outer lateral surface of the second guide rail 18 being positioned generally on the straight line L1 passing through the center of the bearing hole 16, while the inner lateral surface of the second guide rail 18 being formed on the first tangent TL1 of the inner peripheral face of the bearing hole 16. The second guide rail 18 is formed to have a width smaller than that of the first guide rail 17 as shown in FIG. 2. That is, the second guide rail 18 is narrower than the first shaft tip section 27 formed in the shaft section 23 of the later-described lever 3, and is large enough for the second shaft tip section 28 to go therethrough.

(1.2. Handle Grip 2)

The handle grip 2 has one end section mounted on the handle support section 6 as mentioned above. The other end section of the handle grip 2 has the pressing section 20 formed via the connecting section 19.

(1.3. Lever 3)

The lever 3 is composed of, as shown in FIG. 1 and FIG. 4, a weight section 21, an operating section 22, and a shaft section 23. A holding recessed section 24 is formed in the weight section 21. A clip 25 is fitted into the holding recessed section 24. A rod 5 is connected to the clip 25 so that an unshown latch mechanism can be driven. The operating section 22 is constituted of a plate-like section which projects from the weight section 21, and its top end serves as a pressure receiving section 26 which bulges in a circular shape. The pressing section 20 of the handle grip 2 comes into contact with the pressure receiving section 26, so that the rotational operation of the handle grip 2 is transmitted to the lever 3.

The shaft section 23 is provided on the base side (weight section side) of the operating section 22 so as to project from both the sides of the operating section 22 in the orthogonal direction. One projecting portion (first shaft section 23A) has a small-diameter section 23*a* having a generally D shape in cross section in its front end, which is rotatably supported by the bearing hole 13 of the first bearing section 11A, and has a return spring 4 placed in its outer circumference. The projection dimension of the other projecting portion (second shaft 23B) is smaller than that of the first shaft section 23A, with a first shaft tip section 27 projecting from the end face thereof, and a second shaft tip section 28 further projecting from the end face of the first shaft tip section 27.

Figure 5:
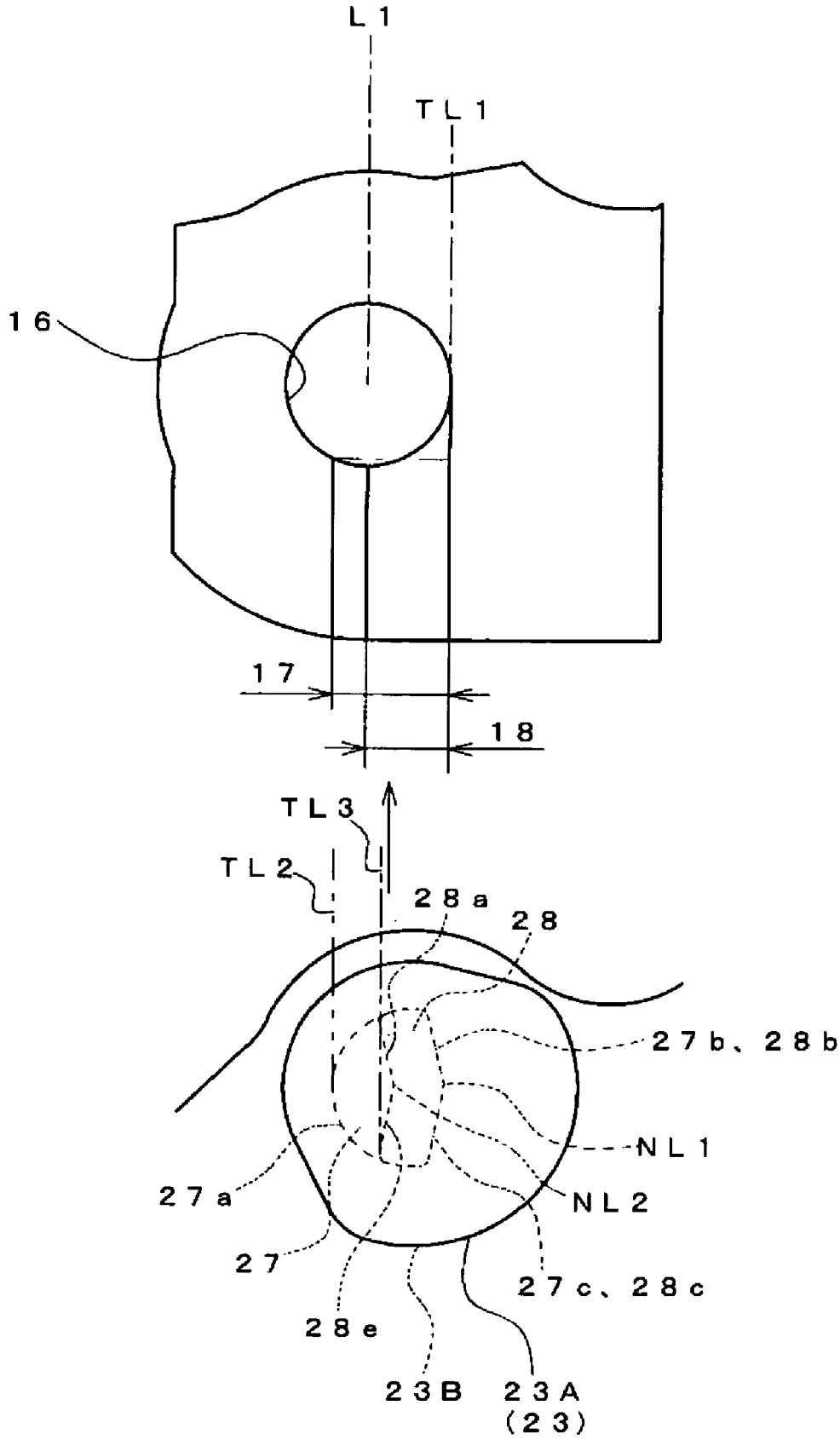
FIG. 5 is a fragmentary enlarged view of FIG. 4.

As shown in FIG. 5, the first shaft tip section 27 is provided so as to project from the end face of the second shaft 23B in the direction of the tip of the rotating shaft (rear side in the page of FIG. 5), and a part thereof is cut away to form a circular face 27*a*, which is generally dogleg shaped, along the peripheral face of the second shaft 23B. An interval between a second tangent TL2 of the circular face 27*a* and an intersection NL1 between the end faces 27*b* and 27*c* formed by the cutting is formed to be narrower than the diameter of the bearing hole 16 of the handle base 1. The value of this interval is so set as to allow insertion of the first shaft tip section 27 into the first guide rail 17. The second tangent TL2 herein refers to a tangent at the position where the first shaft tip section 27 most closely approaches one outer lateral surface of the first guide rail 17 when the first shaft tip section 27 is inserted into the first guide rail 17 as shown in FIG. 5 (the small-diameter section 23*a* is omitted for the sake of explanation). The respective end faces 27*b* and 27*c* gradually incline toward the second tangent TL2 side as they approach the peripheral face of the first shaft tip section 27, and the intersection NL1 between these end faces 27*b* and 27*c* is at the position farthest from the second tangent TL2.

The second shaft tip section 28 is provided so as to project generally in a dogleg shape from the end face of the first shaft tip section 27 in the direction of the tip of the rotating shaft (rear side in the page of FIG. 5). The second shaft tip section 28 has end faces 28*b*, 28*c* each flash with the end faces 27*b*, 27*c* of the first shaft tip section 27, and has two end faces 28*d* and 28*e* each provided generally in parallel with the end faces 28*b*, 28*c* on the opposite side of the end faces 27*b*, 27*c*. The value of an interval between a third tangent TL3 connecting the outer circumferential edges of the respective end faces 28*d*, 28*e* and the intersection NL1 is so set as to allow insertion of the second shaft tip section 28 into the second guide rail 18.

(1.4. Return Spring 4)

The return spring 4 is composed of a coil section 4*a* mounted on the shaft section 23 of the lever 3 and a first engaging section 4*b* and a second engaging section 4*c* which extend from both the ends of the coil section 4*a* as shown in FIG. 1. The first engaging section 4*b* is engaged with an engaging groove 14 of the handle base 1, and the second engaging section 4*c* is engaged with an engaged section 3*a* of the lever 3. Consequently, in the state that the lever 3 is mounted on the handle base 1, the lever 3 is biased clockwise around the rotating shaft, and thereby the weight section 21 side engages with the handle base 1 so that further rotation is regulated as in the state shown in FIG. 7. In the state that the lever 3 is mounted on the handle base 1, the first engaging section 4*b* and the second engaging section 4*c* of the return spring 4 are respectively engaged on the side of the guide rails 17 and 18 (lower side in FIG. 7) seen from the axial center of the first shaft tip section 27 of the lever 3. The second engaging section 4*c* is engaged with the engaged section 3*a* of the lever 3 in the state of being biased and moved counterclockwise around a fixed position of the first engaging section 4*b* engaged with the engaging groove 14 of the handle base 1. As a consequence, the eccentric force for moving the return spring 4 in the direction of cancelling its compression acts upon a coil section 4*a* of the return spring 4. More specifically, with the relationship that the first engaging section 4*b* of the return spring 4 is engaged with the handle base 1 and the second engaging section 4*c* is engaged with the lever 3 which is rotation-regulated by the handle base 1, the eccentric force A by the return spring 4 acts on the shaft section 23 of the lever 3, which is in engagement with the coil section 4*a* of the return spring 4, in the direction distanced from and orthogonal to a line connecting respective engaging points of the first engaging section 4*b* and the second engaging section 4*c*, so that the shaft section 23 of the lever 3 is in the state of being biased to the handle base 1 in the opposite direction of the respective guide rails 17 and 18.

(2. Assembly Method)

Description is now given of the assembly method of the vehicle door handle apparatus.

Figure 6:
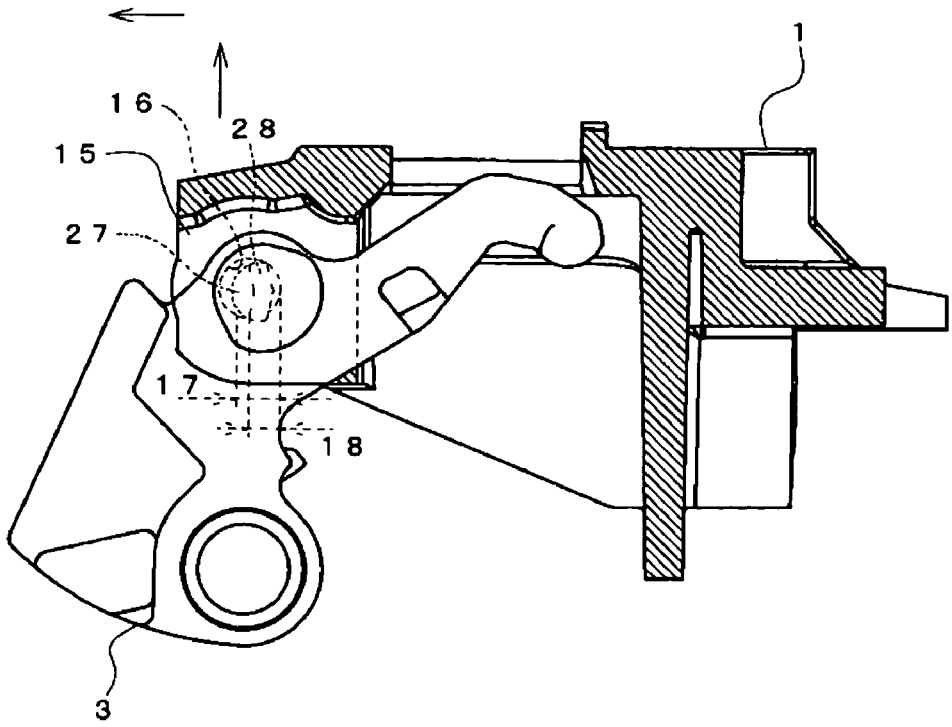
FIG. 6 is a fragmental cross sectional front view showing the handle base of FIG. 4 with a lever mounted thereon.

First, the lever 3 is mounted on the lever supporting section 7 of the handle base 1. The return spring 4 is externally mounted on the shaft section 23 of the lever 3, and the second engaging section 4*c* is engaged with the lock receiving section 3*a* of the lever 3 in advance. Next, as shown in FIG. 4, the first shaft tip section 27 and the second shaft tip section 28 are inserted into the first guide rail 17 and the second guide rail 18 formed in the handle base 1, respectively. As the shaft section 23 reaches the bearing hole 16, first, the outer circumferential edges of the end faces 27*b* and 28*b* of the first shaft tip section 27 and the second shaft tip section 28 respectively come into contact with the inner peripheral face of the bearing hole 16 before the respective shaft tip sections 27 and 28 slip away from the first guide rail 17 and the second guide rail 18, by which further insertion becomes impossible. However, when the shaft tip sections 27 and 28 are each inserted while being rotated counterclockwise, the outer circumferential edges of the end faces 27*b* and 28*b* of the respective shaft tip sections 27 and 28 move along the inner peripheral face of the bearing hole 16, while at the same time, interference between the outer circumferential edge of the end face 28*e* of the second shaft tip section 28 and the outer lateral surface of the second guide rail 18 is avoided so that insertion becomes possible, and therefore as shown in FIG. 6 (the small-diameter section 23*a* is omitted for the same of explanation), the first shaft tip section 27 and the second shaft tip section 28 drop out of the first guide rail 17 and the second guide rail 18, respectively. At this point, the shaft section 23 is moved in the direction crossing the insertion direction (i.e., in the orthogonal direction in this case). Further, the engaging section 4*b* of the return spring 4 is engaged with the engaging groove 14 of the handle base 1. As a consequence, the lever 3 is put in the state of being biased clockwise, i.e., in the direction that the outer circumferential edges of the end faces 27*c* and 28*c* of the respective shaft tip sections 27 and 28 are distanced from the second guide rail 18 in FIG. 7 (the small-diameter section 23*a* is omitted for the same of explanation).

Next, the handle grip 2 is mounted on the handle base 1. The handle grip 2 is rotatably mounted by putting one end side of the pressing section 20 into contact with the pressure receiving section 26 of the lever 3 and putting the other end side in the state of being pivotally supported by the pivotal supporting section 6*a* of the handle support section 6. In this mounting state, the lever 3 is rotated clockwise by the biasing force of the return spring 4 as shown in FIG. 8 (the small-diameter section 23*a* is omitted for the sake of explanation), and the handle grip 2 is positioned in the state of most closely approaching the handle base 1.

Figure 8:
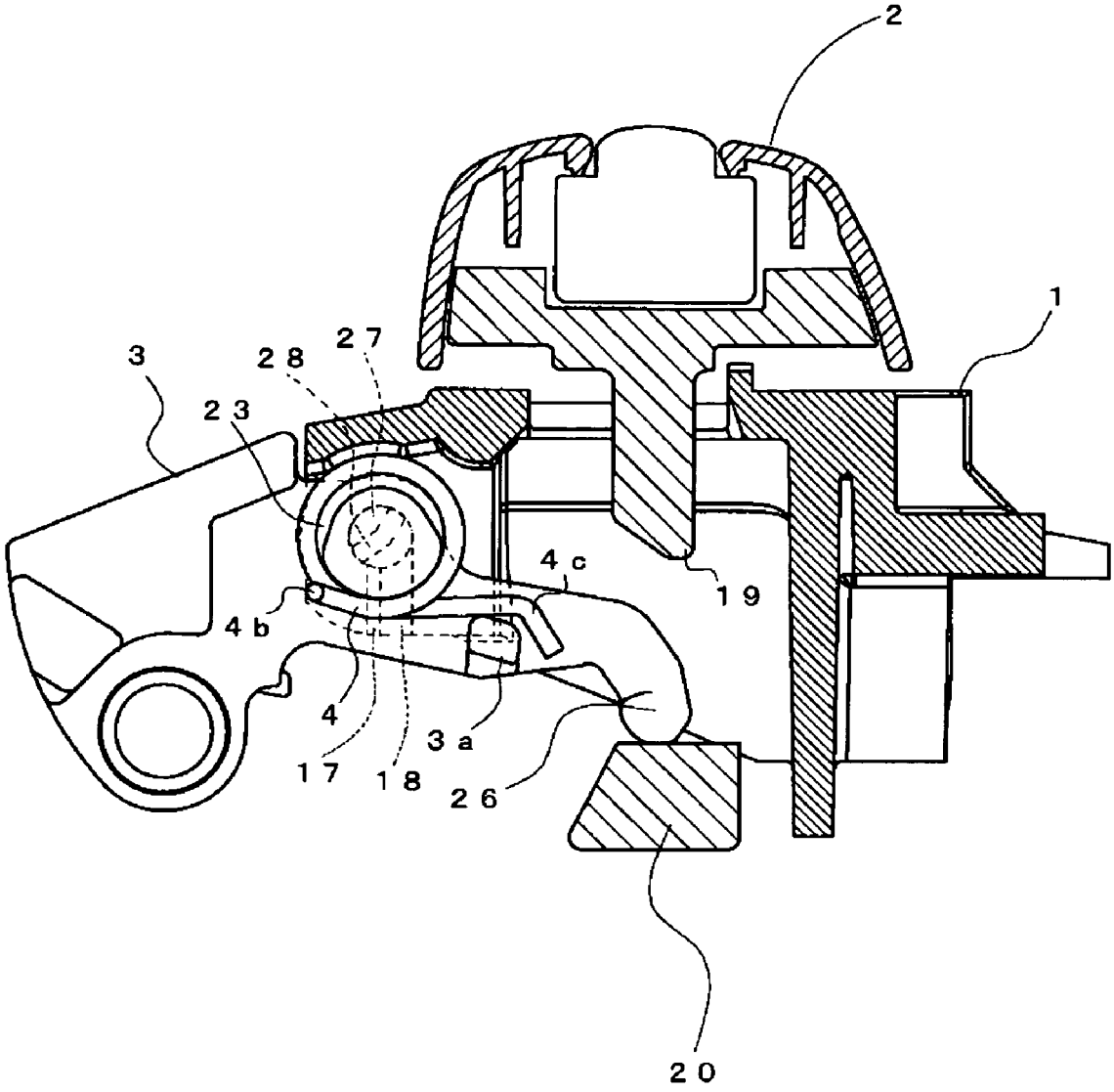
FIG. 8 is a fragmentary cross sectional front view showing the handle base of FIG. 7 with a handle grip mounted thereon.
Figure 9:
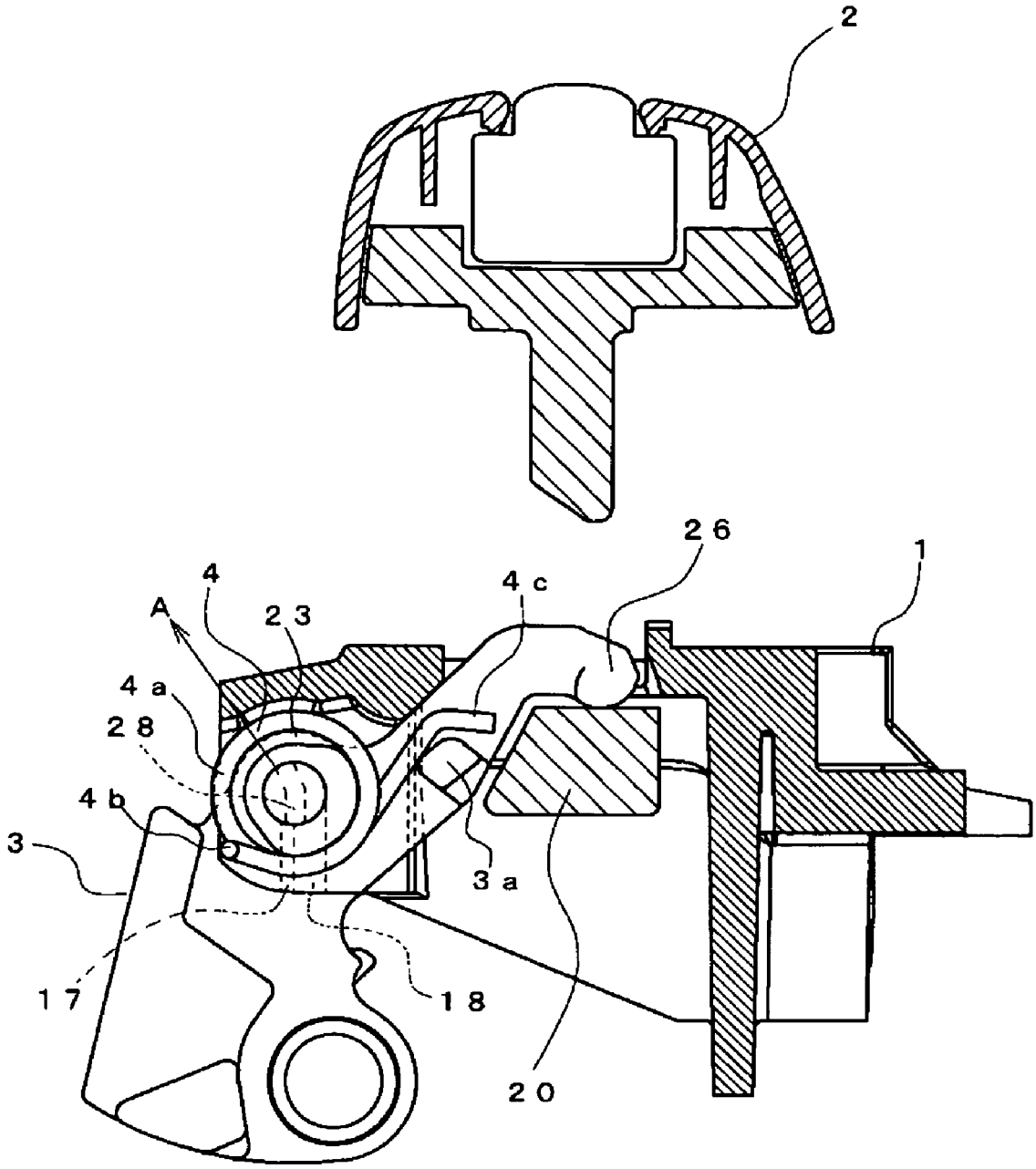
FIG. 9 is a fragmentary cross sectional front view showing the handle grip of FIG. 8 rotated to a maximum pull position.

In the vehicle door handle apparatus assembled in this way, the rotating range of the lever 3 is equal to the normal working range when the handle grip 2 is rotated in the operational maximum range (in the range from the state of FIG. 8 to the fully pulled state in FIG. 9). Even as the handle grip 2 is fully pulled and the lever 3 is in the position rotated counterclockwise as shown in FIG. 9, the first shaft tip section 27 never reaches the escapable position corresponding to the first guide rail 17. In the normal working range of the lever 3, the pressure receiving section 26 of the lever 3 is constantly in engagement with the pressing section 20 of the handle grip 2, and the second engaging section 4*c* of the return spring 4 is in the state of being biased and moved counterclockwise around the fixed position of the first engaging section 4*b*. Consequently, with the relationship that the first engaging section 4*b* of the return spring 4 is engaged with the handle base 1 and the second engaging section 4*c* is engaged with the lever 3 which is rotation-regulated by the handle grip 2, the eccentric force A by the return spring 4 acts on the shaft section 23 of the lever 3, which is in engagement with the coil section 4*a* of the return spring 4, in the direction distanced from and orthogonal to a line connecting respective engaging points of the first engaging section 4*b* and the second engaging section 4*c*, i.e., in the direction generally opposite to the respective guide rails 17, 18, so that the respective shaft tip sections 27 and 28 are prevented from moving to the positions respectively corresponding to the guide rails 17 and 18 in the bearing hole 16. This prevents the shaft tip sections 27 and 28 from escaping from the bearing hole 16.

(3. Operation)

Description is now given of the operation of the vehicle door handle apparatus.

As described before, in the state where the door is closed before the operating of the handle grip 2, the lever 3 is rotated clockwise by the biasing force of the return spring 4 as shown in FIG. 8, and the handle grip 2 is positioned in the state of most closely approaching the handle base 1. A latch mechanism maintains the door closed via the rod 5.

In this state, when an operator carrying an electronic key (not shown) grips the handle grip 2 and operates the switch, a door lock system (not shown) is put in an unlock condition. Accordingly, the operator pulls the handle grip 2 from the door and rotates the handle grip 2 around the handle support section 6. With the rotation of the handle grip 2, the pressing section 20 presses the pressure receiving section 26 of the lever 3, so that the lever 3 rotates counterclockwise, as shown in FIG. 9, against the biasing force of the return spring 4.

In this case, although the first shaft tip section 27 of the lever 3 moves toward the guide rail side, the shaft tip sections 27 and 28 never reach the position corresponding to the respective guide rails 17 and 18 even in the state that the handle grip 2 is fully pulled (FIG. 9) as mentioned above, and also since the shaft tip sections 27 and 28 are biased by the eccentric force A of return spring 4 in the direction generally opposite to the respective guide rails 17 and 18, the respective shaft tip sections 27 and 28 are prevented from moving to the positions respectively corresponding to the guide rails 17 and 18 in the bearing hole 16, which prevents the shaft tip sections 27 and 28 from escaping from the bearing hole 16. Thus, in the normal operation of the handle grip 2, the shaft tip sections 27 and 28 are each prevented from escaping from the bearing hole 16.

Figure 10:
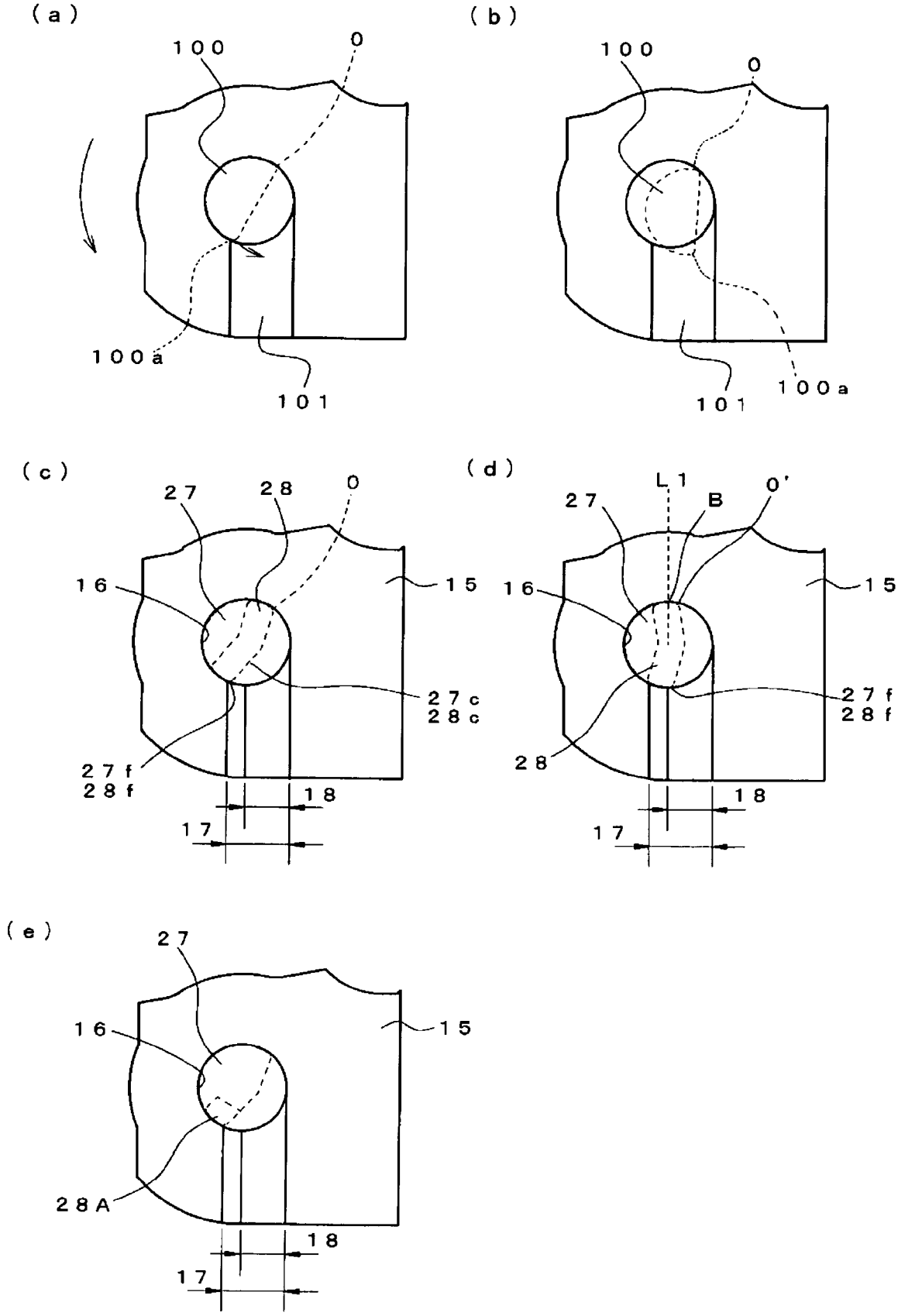
FIGS. 10A and 10B are cross sectional views of a bearing section and a shaft section according to a conventional example.
FIGS. 10C and 10D are cross sectional views of a bearing section and a shaft section according to the present embodiment.
FIG. 10E is a cross sectional view of a bearing section and a shaft section according to another embodiment.

In the door handle apparatus, the shaft tip section may drop out of the bearing hole when an operator performs such operation as rotating the lever 3 while pushing the weight section 21 side of the lever 3 toward the guide rail during assembly works or others. For example, when a single shaft tip section 100 having a generally D shape in cross section is formed at the tip of the shaft section 23 as shown in FIG. 10A, and the weight section 21 side of the lever 3 is operated to rotate the lever 3 counterclockwise, the shaft section 23 rotates while receiving the force which presses the shaft section 23 in the direction generally opposite to the weight section 21 as seen from the shaft section 23. As a circular face end section 100*a* reaches a guide rail 101, the held state of the circular face end section 100*a* is canceled, so that the shaft section 23 may start to rotate around a fulcrum O and the shaft tip section 100 may keep on moving to the guide rail 101 against the eccentric force A of the spring 4, which may cause the shaft tip section 100 to drop into the guide rail 101 as shown in FIG. 10B.

Figure 7:
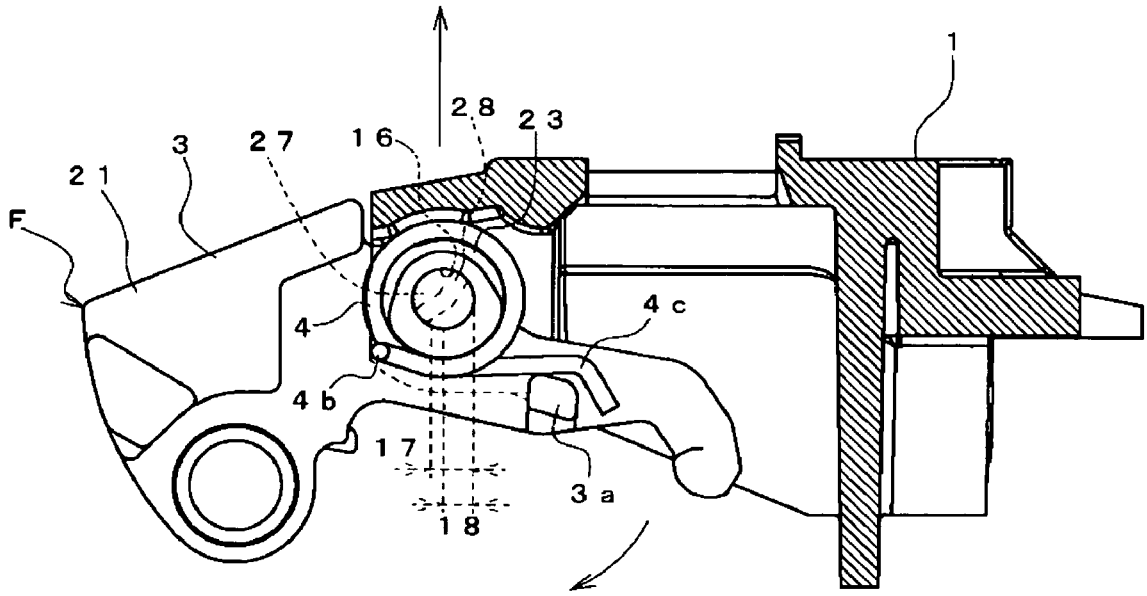
FIG. 7 is a fragmentary cross sectional front view showing the handle base of FIG. 6 with a return spring mounted thereon.

In the door handle apparatus of the present embodiment, when an operator operates the weight section 21 side of the lever 3 with control force F, for example, in the state shown in FIG. 7 to rotate the lever 3 counterclockwise, and this results in the state of FIG. 10C, an outer circumferential edge 27*f* of the end face 27*c* of the first shaft tip section 27 reaches the first guide rail 17 as in the above case, so that the held state of the end section 27*f* is canceled. However, an outer circumferential edge 28*f* of the end face 28*c* of the second shaft tip section 28 does not reach the second guide rail 18 whose width is narrower than the first guide rail 17, and so the held state of the second shaft tip section 28 by the inner peripheral face of the bearing hole 16 is maintained, which prevents the respective shaft tip sections 27 and 28 from dropping out of the respective guide rails 17 and 18.

As the lever 3 further rotates counterclockwise and ends up in the state of FIG. 10D, the end section 28*f* of the second shaft tip section 28 moves to a position corresponding to the outer lateral surface of the second guide rail 18. At this point, with control force F, such force as pressing the shaft section 23 in the direction generally opposite to the weight section 21 as seen from the shaft section 23 acts upon the shaft section 23, and so the shaft section 23 henceforth rotates around a fulcrum O'. However, compared to the fulcrum O in the case of providing the single shaft tip section 100 shown in FIG. 10A, the fulcrum O' moves along the inner peripheral face of the bearing hole 16 in the counterclockwise direction and positions in the vicinity of an intersection B between a straight line L1, which passes through the center of the bearing hole 16 and which is in parallel with the first guide rail 17, and the inner peripheral face of the bearing hole 16, and the outer circumferential edge 28*f* side of the second shaft tip section 28 moves toward the inner lateral surface of the second guide rail 18 in the generally orthogonal direction. A this point, since the control force F by the operator is not directed, by rotation of the lever 3, to the direction of the respective guide rail 17 and 18 but directed toward the direction displaced from the respective guide rail 17 and 18 direction, the second shaft tip section 28 does not drop into the second guide rail 18.

When the operator removes his/her hand from the lever 3 in this state, the circular face 27*a* of the first shaft tip section 27 is pressed to the inner peripheral face of the bearing hole 16 by the eccentric force of the return spring 4, while the lever 3 is rotated clockwise by the biasing force of the return spring 4, and thereby the state of FIG. 7 is recovered.

Thus, in the door handle apparatus of the present embodiment, even when the lever 3 rotates and a part of the first shaft tip section 27 reaches the first guide rail 17 in the case of rotating operation of the lever 3 during mounting work, a part of the second shaft tip section 28 does not yet reach the second guide rail 18 which is formed so as to be narrower than the first guide rail 27.

Accordingly, even when the first and second tip sections 27 and 28 are suddenly operated so that they escape in the direction of the first and second guide rail 17 and 18, the held state of the second shaft tip section 28 by the bearing hole 16 is maintained in the large range, which makes it possible to prevent the first and second tip sections 27 and 28 from escaping from the bearing hole 16 of the bearing section 11. Moreover, even when the second shaft tip section 28 is formed with a small width, the shaft section 23 is held in the bearing hole 16 by the first shaft tip section 27 which is wider than the second shaft tip section 28, and therefore the strength of the shaft section 23 will not be compromised.

Moreover, it becomes possible to achieve furthermore effective prevention of the dropout of the shaft section 23 from the bearing section 11 by providing the return spring 4 which biases the lever 3 in a rotation direction around the shaft section 23 and which has engaging sections on both ends engaged so that eccentric force may act in a direction in which the first shaft tip section 27 is distanced from the first guide rail 17.

Further, it becomes possible to prevent at least the first shaft tip section 27 from being placed at the position where the first shaft tip section 27 can drop out of the first guide rail 17 by just inserting the first shaft tip section 27 into the first guide rail 17 and moving it in the crossing direction. In short, it becomes possible to implement the structure which offers resistance to dropout only by mounting the shaft section 23 so as to be rotatably supported by the bearing hole 16. The state of being unable to drop out is maintained by the eccentric force of the return spring 4. Therefore, even as the lever 3 rotates to a rotating position for mounting operation, the shaft section 23 of the lever 3 does not drop out from the bearing hole 6, and therefore the rotating position for mounting the lever 3 can be set in the normal operation range of the lever 3. As a result, it becomes possible to enhance the design flexibility.

Furthermore, as the lever 3 rotates and one edge 27*f* in the circular face 27*a* of the first shaft tip section 27 reaches the first guide rail 17, the held sate of one edge 27*f* of the first shaft tip section 27 is canceled. In this case, if one edge 28*f* of the second shaft tip section 28 is structured so as not to enter into the second guide rail 18, the second shaft tip section is still put in the state of being held in the inner peripheral face of the bearing hole 16, and therefore the second shaft tip section 28 is prevented from dropping into the second guide rail 18. In short, it becomes possible to make the shaft section 23 hardly drop out of the bearing section 11.

In the above embodiment, the second shaft tip section 28 is provided so as to project generally in a dogleg shape from the end face of the first shaft tip section 27 in the direction of the rotating shaft. However, without being limited to this structure, the second shaft tip section 28 may be structured, for example, as a projection 28A provided along a part of the circumference surface of the first shaft tip section 27 as shown in FIG. 10E.

The invention claimed is:

1. A vehicle door handle apparatus, comprising:

a handle base for rotatably supporting one end side of a handle grip; and a lever which has a shaft section rotatably supported by a bearing section of the handle base and which is rotated upon pulling of the handle grip, wherein the lever comprises:

(i) a first shaft tip section projecting from the shaft section to a shaft tip side and having a part cut away so as to form a circular face; and (ii) a second shaft tip section projecting from the first shaft tip section to the shaft tip side and having a width smaller than that of the first shaft tip section, the second shaft tip section being formed on an end face of the first shaft tip section, wherein the handle base comprises:

(i) a bearing hole for rotatably supporting the first shaft tip section and the second shaft tip section of the lever;

(ii) a first guide rail for guiding the first shaft tip section to the bearing hole, the first guide rail having a width smaller than the bearing hole; and (iii) a second guide rail for guiding the second shaft tip section to the bearing hole, the second guide rail being narrower than the first shaft tip section, wherein the first guide rail is displaced from a straight line passing through a center of the bearing hole, and wherein the second guide rail includes one lateral face disposed on the same plane as the straight line passing through the center of the bearing hole, and the other face of the second guide rail is disposed on the same plane as a lateral face of the first guide rail.

2. The vehicle door handle apparatus according to claim 1, further comprising a return spring which biases the lever in a rotation direction around the shaft section and which has engaging sections on both ends locked so that eccentric force may act in a direction in which the first shaft tip section is distanced from the first guide rail.

3. The vehicle door handle apparatus according to claim 2, wherein the lever is configured such that the second shaft cannot enter into the second guide rail when one edge of the circular face of the first shaft tip section comes into contact with an inner peripheral face of the bearing hole in a state that the other edge of the circular face is positioned in one outer lateral surface of the first guide rail and is used as a rotary fulcrum of the shaft section.

4. The vehicle door handle apparatus according to claim 2, wherein a rotation direction of the shaft section of the lever at a time of pulling the handle grip is so set that an end section of an end face of the first shaft tip section and the second shaft tip section may reach a lateral face of the first guide rail prior to a lateral face of the second guide rail.

5. The vehicle door handle apparatus according to claim 4, wherein the lever is configured such that the second shaft cannot enter into the second guide rail when one edge of the circular face of the first shaft tip section comes into contact with an inner peripheral face of the bearing hole in a state that the other edge of the circular face is positioned in one outer lateral surface of the first guide rail and is used as a rotary fulcrum of the shaft section.

6. The vehicle door handle apparatus according to claim 4, comprising a return spring which biases the lever in a rotation direction around the shaft section and which has engaging sections on both ends locked so that eccentric force may act in a direction in which the first shaft tip section is distanced from the first guide rail, wherein the bearing hole is placed so that a center thereof is displaced from a center of each of the first shaft tip section and the second shaft tip section, which are guided via each of the guide rails, in a direction crossing the guiding direction, and wherein, after the first shaft tip section is inserted into the bearing hole via the first guide rail, the bearing hole is in a state of being displaced in the crossing direction, and the displaced state is held by the eccentric force of the return spring.

7. The vehicle door handle apparatus according to claim 6, wherein the lever is configured such that the second shaft cannot enter into the second guide rail when one edge of the circular face of the first shaft tip section comes into contact with an inner peripheral face of the bearing hole in a state that the other edge of the circular face is positioned in one outer lateral surface of the first guide rail and is used as a rotary fulcrum of the shaft section.

8. The vehicle door handle apparatus according to claim 1, wherein a rotation direction of the shaft section of the lever at a time of pulling the handle grip is so set that an end section of an end face of the first shaft tip section and the second shaft tip section may reach a lateral face of the first guide rail prior to a lateral face of the second guide rail.

9. The vehicle door handle apparatus according to claim 1, comprising a return spring which biases the lever in a rotation direction around the shaft section and which has engaging sections on both ends locked so that eccentric force may act in a direction in which the first shaft tip section is distanced from the first guide rail, wherein the bearing hole is placed so that a center thereof is displaced from a center of each of the first shaft tip section and the second shaft tip section, which are guided via each of the guide rails, in a direction crossing the guiding direction, and wherein, after the first shaft tip section is inserted into the bearing hole via the first guide rail, the bearing hole is in a state of being displaced in the crossing direction, and the displaced state is held by the eccentric force of the return spring.

10. The vehicle door handle apparatus according to claim 1, wherein the lever is configured such that the second shaft cannot enter into the second guide rail when one edge of the circular face of the first shaft tip section comes into contact with an inner peripheral face of the bearing hole in a state that the other edge of the circular face is positioned in one outer lateral surface of the first guide rail and is used as a rotary fulcrum of the shaft section.

* * * * *